United States Patent [19]

Clancy, Jr.

[11] Patent Number: 4,502,183

[45] Date of Patent: Mar. 5, 1985

[54] CAM OPERATED DOOR HINGE

[75] Inventor: Frank M. Clancy, Jr., Hudson, Ohio

[73] Assignee: The Sanymetal Products Co., Inc., Cleveland, Ohio

[21] Appl. No.: 460,182

[22] Filed: Jan. 24, 1983

[51] Int. Cl.[3] ..... E05F 1/04

[52] U.S. Cl. ..... 16/318; 16/387

[58] Field of Search ..... 16/312, 316, 318, 386, 16/387

[56] References Cited

U.S. PATENT DOCUMENTS

| | | | |
|---|---|---|---|
| 1,330,647 | 2/1920 | Neal | 16/318 |
| 2,205,396 | 6/1940 | Colucci | 16/318 |
| 3,134,134 | 5/1964 | McCubbin | 16/153 |
| 3,545,031 | 12/1970 | Dielman | 16/153 |
| 3,545,032 | 12/1970 | Dielman | 16/153 |
| 3,748,688 | 7/1973 | Berkowitz | 16/312 X |

FOREIGN PATENT DOCUMENTS 2129026 12/1971 Fed. Rep. of Germany ..... 16/318

OTHER PUBLICATIONS

Bobrick Washroom Equipment, Inc., 1979 advertising sheet.

*Primary Examiner*—Fred A. Silverberg

*Attorney, Agent, or Firm*—Body, Vickers & Daniels

[57] ABSTRACT

In a cam hinge device having a lower stationary hinge section and an upper hinge section, the improvement comprised of each hinge section having an identically formed, seamless sleeve-like, metal casing with a metal mounting leaf extending laterally therefrom. Plastic block assemblies including the operative camming surfaces of the device are provided within the casing such that the casing and block assembly of the riding hinge section are mounted in an axial position 180° opposite the casing and block assembly of the stationary hinge section when the hinge device is assembled.

5 Claims, 4 Drawing Figures

CAM OPERATED DOOR HINGE

BACKGROUND OF THE INVENTION

The present invention relates to the art of hinges and more particularly to an adjustable cam operated hinge.

The invention is particularly applicable to cam operated hinges for use with doors for lavatory, shower, dressing, or other small compartments and will be described with particular reference thereto; however it will be appreciated that the invention has broader applications and may be used in numerous other hinge applications.

Cam operated hinges, especially adjustable hinges, are adaptable to a wide variety of applications. They are suitable wherever it may be desirable to have a door biased to a neutral position. Such hinges are particularly well suited for use with doors for lavatory, shower, dressing, or other analogous small compartments. In these applications, the hinge is generally subjected to constant use. Such hinges must be functionally reliable, extremely durable, self-contained, and easily adjusted when in a mounted position. The hinge must also be attractive, with an aesthetically pleasing appearance.

Heretofore, adjustable cam operated hinges were generally comprised of a large number of machined or molded pieces. These pieces were primarily of plastic construction because of the ease of forming the camming surfaces and other peculiar shapes found therein. Such plastic fabricated hinge assmeblies even with such large number of pieces were relatively inexpensive to fabricate, but the load bearing capacity was limited by the physical characteristics of the plastic material. Metal cam hinges, though having increased load bearing capacity, are considerably more expensive because of the casting or machining required to fabricate the camming surfaces and odd shapes.

More recently hinges utilizing both plastic and metal have been developed. Heretofore, such hinges had hinge sections which were generally comprised of a plastic inner portion, which provides the inner structure of the hinge, and a metal outer portion. The outer metal portion of these hinges includes a metal mounting leaf, and is generally formed from a single flat sheet of metal which is bent and shaped to provide an opened body area, which accepts the plastic portion, and the mounting leaf. The mounting leaf thus consists of two sheets of metal side by side, and has an overall thickness twice that of the sheet forming the body area. The molded plastic portion is fixedly inserted into the opened body portion of the hinge section. The hinge has a lightweight plastic inner structure and a durable outer casing or shell.

The problem with this type of construction, as mentioned above, is that the resulting thickness of the mounting leaf is always twice the thickness of the metal shell. This overlapping metal forming the mounting leaf adds little structural strength to the body of the hinge, but increases the cost of the hinges, especially if high-priced metal such as stainless steel is used. Also, the fabrication costs of such hinges are high because of the considerable bending and shaping which is required to form the metal body of such sections. In addition, the thicker the metal sheet, the more difficult the bending and forming operations.

The present invention contemplates an improvement over the plastic and metal hinge described above, which improved hinge is sturdy, attractive, and economical to fabricate.

SUMMARY OF THE INVENTION

In accordance with the present invention, a hinge of the type described above, having an inner plastic portion and an outer metal portion is provided wherein the other metal portion comprises a seamless, sleeve-like metal casing which is fixedly secured to a generally flat metal mounting piece.

The primary object of the present invention is to provide a cam hinge device having adjustable camming means, which hinge device is mechanically and structurally superior to devices known heretofore, is simple to install and adjust, and is economical to fabricate.

Another object of the present invention is to provide a cam hinge device having an outer metal casing and metal mounting leafs rigidly secured thereto, which device is structurally strong and durable and has an attractive outer appearance.

A still further object of the present invention is to provide an adjustable cam hinge device of the above referred to type wherein the internal structure of the hinge is comprised of molded plastic pieces, and wherein the plastic pieces can be easily assembled in fixed relation within the metal casings.

An even further object of the present invention is to provide an adjustable cam hinge device as described above wherein the metal casing and the laterally extending leaf portions can be easily and inexpensively fabricated from generally standard structural metal forms, and the metal casing provides a maximum amount of strength with a minimum amount of material.

BRIEF DESCRIPTION OF THE DRAWINGS

These and other objects and advantages of the invention will become apparent from the following description of a preferred embodiment thereof taken together with the accompanying drawings in which.

DETAILED DESCRIPTION OF THE PREFERRED EMBODIMENT

Figure 1:
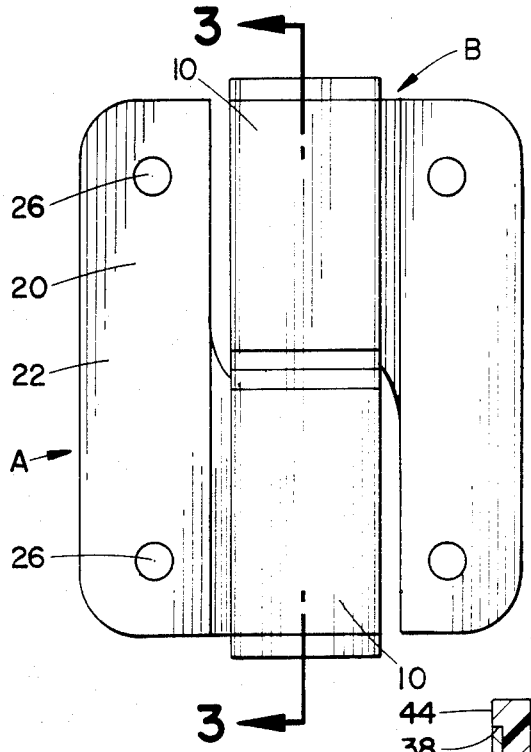
FIG. 1 is a front elevational view of a hinge incorporating the concept of the present invention wherein the camming surface on the hinge pintle sleeve is positioned to provide the neutral position when the hinge mounting leafs are disposed 180° apart about the hinge axis.

Referring now to the drawings wherein the showings are for the purpose of illustrating a preferred embodiment of the invention only and not for the purpose of limiting same, an adjustable cam hinge as shown in FIG. 1 has a lower stationary hinge section A and an upper riding hinge section B.

Figure 2:
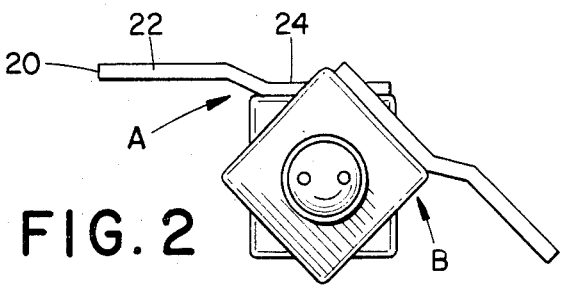
FIG. 2 is a top plan of the hinge shown in FIG. 1 wherein the upper riding hinge section is rotated 45° from the neutral position.

The hinge sections A and B each have an outer seamless sleeve-like metal casing 10 having a generally rectangular or square cross-section and an outer surface 12 and inner surface 14. End surfaces 16 and 18 face along the axis of the hinge assembly. A mounting leaf 20 extends from the rectangular casing 10. Leaf 20 is generally L-shaped and has an elongated axially extending mounting portion 22 and a casing engagement portion 24. Mounting portion 22 and engagement portion 24 are generally disposed in parallel planes but are off-set slightly (as best seen in FIG. 2). This allows the corner of the rectangular casing 10 to pivot past any mounting surface the hinge may be secured to. Mounting holes 26 are provided on the mounting portion 22 of leaf 20 to facilitate mounting on a door pilaster or wall. Engagement portion 24 of leaf 20 abuts flush against the outer surface of one side of the rectangular casing 10, and is fixedly secured thereto.

In the preferred embodiment, seamless casing 10 is a drawn rectangular tube. It will be appreciated however, that casing 10 can be formed by a number of different methods, each of which will produce a seamless, sleeve-like casing. For example the casing may be formed by bending flat stock into the rectangular shape when welding and grinding the abutting edge to provide a flat seamless surface.

In the preferred embodiment seamless casing 10 and leaf 20 are fabricated from standard structural stainless steel, casing 10 being standard stainless steel rectangular tubing and leaf 20 being fabricated from stainless flat stock. Leaf 20 can thus be easily and securely fixed flatwide to casing 10 by a welding operation, thereby providing the hinge with a durable and structurally strong outer surface and mounting member. A casing 10 of structural stainless steel provides a maximum amount of strength while using a minimum amount of metal material.

Figure 3:
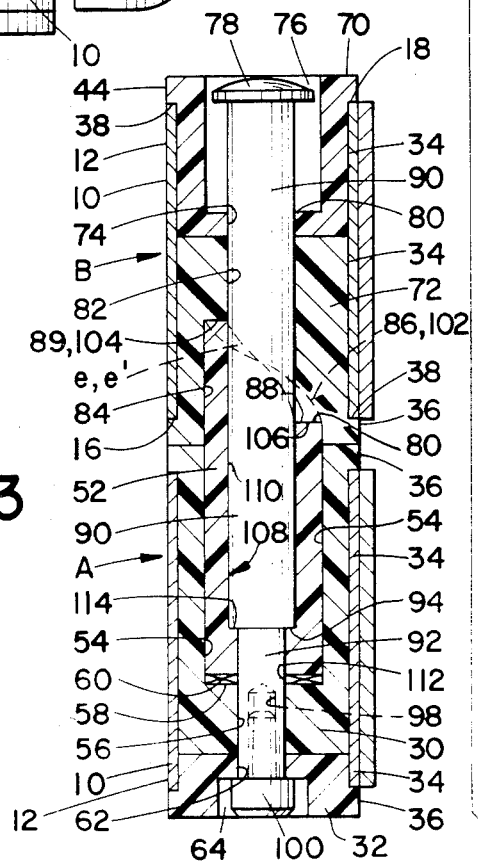
FIG. 3 is an axial cross-sectional view of the hinge shown in FIG. 1 taken generally along the line 3—3 of FIG. 1.

A sleeve-receiving piece or block 30 and lower cap piece of block 32 together form a block assembly which is encased or inserted within the casing 10 of the lower hinge section A, as best shown in FIG. 3. Both blocks or pieces 30 and 32 have generally rectangular cross-sections and have a portion 34 which is to be inserted in the casing 10. A flange or lip portion 36 is provided at the outer end of each encased portion 34. The flange or lip portions 36 at one end of and adjacent the encased portions 34 of block pieces 30 and 32, extend radially outward and provide an abutting surface 38 for engagement with the end surfaces 16, 18 of the casing 10. Block pieces 30 and 32 are designed such that the outer surfaces 40 of their encased or inserted portions 34 provide sliding engagement with inner surface 14 of casing 10. Axially extending ribs or ridges 42 protrude slightly from the surfaces 40 of the block pieces 30 and 32. These ridges or ribs 42 cause interfering engagement with inner surface 14 of casing 10, thus providing a forced or wedged fit of the blocks 30 and 32 into casing 10.

In assembled position, sleeve-receiving block 30 is forced into the top of the casing 10 of the lower hinge section A, as shown in FIG. 3, with the abutting surface 38 on its flange 36 engaging end surface 16 of casing 10. Bottom cap block 32 is wedged into the bottom of the casing 10 with its abutting surface 38 engaging end surface 18 of casing 10. In the preferred embodiment, the outer surfaces 44 of the flanges 36 on block pieces 30 and 32 are adapted to be flush with the outer surface 12 of casing 10.

Block pieces 30 and 32 of the stationary lower hinge section A have an axial opening of varying diameter extending therethrough to accommodate a hinge pintle 50 and a pintle receiving sleeve 52. As best seen in FIG. 3, sleeve-receiving block piece 30 has a cylindrical sleeve-receiving axial passageway portion 54 and, at its lower end, a cylindrical pintle-receiving axial passageway portion 56 of somewhat smaller diameter than and communicating with passageway portion 54. An upwardly facing annular shoulder 58 is formed at the junction of passageway portions 54 and 56. Annular shoulder 58 is provided with radially extending serrations schematically indicated at 60. Lower cap piece 32 has a pintle-receiving passageway portion 62 which is aligned with and corresponds in diameter to passageway portion 56 in sleeve-receiving block piece 30. The passageway 62 in bottom cap 32 is counterbored at its outer end to provide an enlarged recess 64 for the head of fastening screw 100.

As will be appreciated by further reading and understanding of the specification and drawings, the general structure and assembly of the upper hinge section B is similar to lower stationary hinge section A. Therefore, in the description of hinge section B, parts will be described with numbers which correspond to similar parts of lower stationary hinge section A.

Upper hinge section B also comprises a metal casing 10 and leaf portion 20 generally identical to lower hinge section A. The casing 10 and leaf portion 20 of the upper hinge section B are manufactured and assembled identically to the metal pieces of the stationary or lower hinge section A; however, in the assembly of the hinge, the casing 10 and leaf 20 of the upper hinge section B are mounted in an axial position 180° opposite those of the lower hinge section A. An upper cap piece or block 70 and an upper cam piece or block 72 comprise the block assembly of upper hinge section B.

The upper block pieces 70 and 72 are, like the lower block pieces 30, 32, generally rectangular in cross-section and have a portion 34 which is encased or inserted into the metal casing 10 and a flange or lip portion 36. The flange or lip portion 36 has outer facing surfaces 44 and provides an abutting surface 38. Ribs 42 are provided on surface 40 of the insert or encased portion 34. In the assembled position, as best seen in FIG. 3, portion 34 of upper cap block 70 is inserted in the upper end of casing 10 of hinge section B. Annular abutting surface 38 on the flange 36 of upper cap piece 70 engages outer end surface 18 of casing 10. Cam piece or block 72 is inserted in the lower end of casing 10 with annular surface 38 of flange 36 engaging end surface 16 of casing 10. The axial passageway 56, 54 for hinge pintle 50 and pintle sleeve 52 which extends through the lower hinge section also extends through the block pieces 70 and 72 of the upper hinge section B. Cap piece 70 has a cylindrical pintle-receiving axial passageway portion 74 for sliding engagement with a main shank portion 90 of the pintle 50. Upper cap block 70 also has an upwardly opening counterbored passageway 76 of extended length for accommodating and allowing free reciprocal movement therein of the flared cap or head portion 78 of the hinge pintle 50. The annular shoulder 80 formed in cap piece 70 by the counterbored passageway 76 therein is engageable with the head end portion 78 of pintle 50 to retain the upper hinge section B in place on the pintle 50 against axial separation therefrom off the head end portion 78. Cam block piece 72 has a cylindrical pintle-receiving axial passageway portion 82 within its upper end portion for sliding engagement with pintle 50. Passageway portion 82 is of the same diameter as, and is axially aligned and communicates with the adjacent pintle-receiving passageway portion 74 in cap piece 70. At its lower end, cam block piece 72 is formed with a downwardly opening cylindrical axial passageway 84 communicating with and of somewhat larger diameter than the adjacent passageway portion 82 for accommodating the pintle sleeve 52 therein. The downwardly facing shoulder at the junction between the different diameter passageway portions 82, 84 is formed so as to present a pair of complementary semicircular spiral cam tracks 86 each extending approximately 180° in axial extent around the wall of passageway 84 to form a peak 88 at their adjoining lower or outermost ends and a valley 89 at their adjoining upper or innermost ends. Peak 88 and valley 89 of cam track 86 thus are separated by 180° extending spirally-formed camming surfaces e.

The hinge pintle 50 referred to above aligns the upper hinge section B with the lower stationary hinge section A. Pintle 50 comprises a main shank portion 90 of cylindrical form. A mushroomed or flared head portion 78 is provided at one end of shank portion 90. A cylindrical extension 92 of smaller cross-sectional diameter than the main shank portion 90 extends axially from the opposite end thereof. An annular shoulder 94 is thus provided at the junction between the shank portion 90 and the extension 92. At its outer end, the extension 92 is provided with a tapped and threaded hole 98 for screw thread engagement with a locking or fastening screw 100. In the preferred embodiment, pintle 50 is of metal construction. The pintle 50 is of a length such that, in the assembled position of the hinge sections A, B as shown in FIG. 3, the underside of the pintle head portion 78 will be spaced from the annular shoulder 80 in the counterbore passageway 76 of upper cap piece 70 a distance at least equal to and preferably somewhat greater than the total axial height or rise of the camming surfaces e along the hinge axis, when the hinge assembly is in its neutral position.

Figure 4:
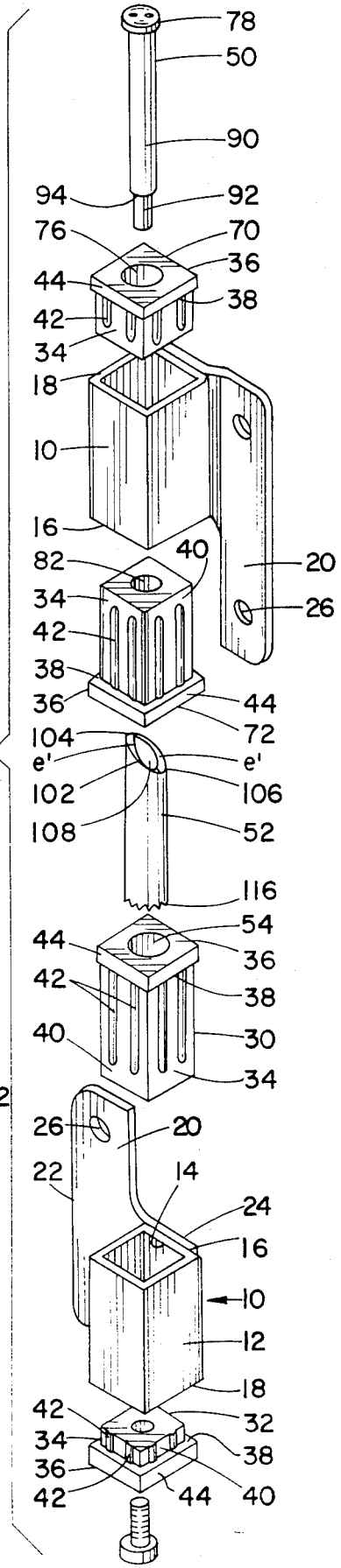
FIG. 4 is a perspective exploded view of the hinge shown in FIG. 1.

Hinge pintle sleeve 52 is of generally cylindrical form having an annular cam track 102 on one end, i.e., its upper end, which more or less matches and is in opposing engagement with the cam tracks e within the cam block piece 72 to thereby support the upper hinge section B on the lower hinge section A. Cam track 102 is formed with a peak 104 and a valley 106 separated by 180° extending, spirally formed complementary camming surfaces e'. Camming surfaces e' are designed to mate in complementary fashion with cam surfaces e of the interior cam track 86 of cam block piece 72. A cylindrical bore or axial passageway 108 is provided in sleeve 52 to receive the pintle 50. An extend upper portion 110 of the bore 108 journals the main shank portion 90 of the hinge pintle 50, while a short lower bore portion 112 of reduced diameter is provided to journal the cylindrical extension 92 of the pintle. The junction of bore 110 and the smaller passageway or bore 112 provides an annular shoulder 114. The end of sleeve 52 opposite the end thereof provided with the cam track 102 is formed with radial extending serrations 116 (FIG. 4) adapted to mate in complementary fashion with the internal serrations 60 on sleeve-receiving block 30 to lock the sleeve 52 and block 30 in a desired selected rotative position relative to one another. In the preferred embodiment, the block pieces 70,72 and 30,32 of the upper and lower hinge sections, and the hinge pintle sleeve 52, are all formed of a durable nylon material. It will be appreciated, however, that these parts can be formed from any of a number of suitable plastic materials having good molding and wear characteristics.

In assembled condition, the upper hinge block pieces 70 and 72 are press fitted into casing 10 of upper hinge section B, and lower hinge blocks 30 and 32 are press fitted into casing 10 of lower hinge section A, as generally shown in FIG. 3. The shank portion 90 of pintle 52 is passed, with its reduced diameter end 92 first, successively through the bore passageway portions 74 and 82 in the block pieces 70, 72 of the upper hinge section B, and thence successively through the bore passageway portions 110, 112 of pintle sleeve 52, which has been previously inserted serrated end 116 first into the bore passageway portion 54 of block piece 30 in the lower hinge section A, and then through the bore passageways 56 and 62 in block piece 34 and bottom end cap 32. Fastening screw 100 is then threaded into the screw-threaded hole 98 in the bottom end of the pintle 50 and tightened to fasten the two hinge sections A and B together in assembled relation, with the upper hinge section B journaled on the shank portion 90 of the pintle 50 so as to freely rotate thereon. With the parts thus assembled, the annular shoulder 94 on pintle 50 engages and presses against the annular shoulder 114 within the bore passageway 110 of the pintle sleeve 52 to thereby hold the serrated lower end 116 thereof in rotative interlocked mating engagement with the serrated annular shoulder 58 in the bore passageway 52 of the block piece 30.

In the usage of the hinge assembly comprising the invention, lower hinge section A is mounted to a wall or door pilaster by means of holes 26 and any of a number of different securing means such as fastening screws, for instance. In a similar manner, upper section B is secured to the door member. Sleeve 52 is located in the required rotative position in block 30 to position the upper hinge section B and the associated door in the desired neutral or lowered position, by unloosening the fastening screw 100 sufficiently to permit access to and turning of the sleeve 52 to such required oriented position. The locking screw 100 is then retightened to draw sleeve 52 and its serrated end 116 back into engagement with block piece 30 and its serrated shoulder 60 by the engagement of the shoulder 94 on pintle 50 with the shoulder 114 on sleeve 52. This then prevents any further axial as well as rotative movement of sleeve 52 relative to the block 30 of the lower hinge section A. Upper hinge section B is, however, free to pivot about pintle 50. Rotational movement of the upper riding hinge section B by swinging movement of the associated door then produces a camming interaction between the engaged camming surfaces e and e' on the block piece 72 and sleeve 52, respectively. This camming interaction causes upper hinge section B to move axially upward along the pintle 50 and thus raise the door. The weight of the door biases the hinge back to its neutral or lowered position.

FIGS. 1 and 3 generally show a hinge of the type disclosed herein with a neutral position which fixes the mounting leafs 22 180° apart about the hinge axis. It will be appreciated that the neutral position may be adjusted to a number of different axially oriented positions by simply re-orienting the pintle sleeve 52 with respect to sleeve receiving block 30. As described above, this is easily accomplished with the present invention by loosening fastening screw 100, and vertically lifting upper hinge section B relative to lower hinge section A. This allows access to the pintle sleeve 52 and disengages inner locking serrations 60 and 116. Sleeve 52 can then be rotated to any desired position relative to block 30. Of course, if two or more hinges are used to support a door, then all of them must be adjusted to the same neutral position.

From the above description, it will be apparent that the present invention provides a metal-encased hinge assembly which is of strong and durable character, of attractive design, and easily adjustable to various neutral door positions. The seamless metal casings 10 and leafs 22 employed in the hinge assembly can be fabricated from standard structural metal forms by simple cutting and shearing or stamping procedures, thus avoiding the need for any expensive machining or casting operations. The plastic inner block pieces 30, 32 and 70, 72 can be fabricated as inexpensive moldings and are easily assembled and secured into the metal casings 10 by simple push-in operations. As a result, a hinge assembly comprised of easily fabricated and assembled members and of relatively inexpensive overall manufacturing cost is provided by the present invention.

FIGS. 1 through 4 show a hinge assembly for left side mounting wherein the stationary hinge section A, which mounts to the door pilaster or door frame, is shown with a leftward extending pilaster mounting leaf 22. It will be appreciated, however, that the present invention can be easily adapted for right side mounting. This and other additional modifications and alterations will occur to others upon their reading and understanding of the specification. It is intended that all such modifications and alterations be included insofar as they fall within the scope of the appended claims or the equivalents thereof.

Having thus described the invention, the following is claimed:

1. In a cam hinge device having a lower stationary hinge section and an upper riding hinge section, each having a cylindrical axial opening extending therethrough, a hinge pintle extending along a hinge axis through said openings supporting and axially aligning said hinge sections for pivotal movement of said riding hinge section relative to said stationary hinge section, a pintle sleeve on said pintle partially disposed within the axial opening of said lower hinge section and projecting into the axial opening of said upper riding hinge section, a cam surface on said sleeve engaging in complementary fashion a cam surface on said riding hinge section within the said axial opening thereof to effect reciprocating movement of said riding hinge section axially on said pintle upon rotation of said riding hinge section relative to said sleeve, and means for adjusting the camming contact between said cam surfaces to selective rotative positions relative to said lower hinge section, the improvement comprising each of said hinge sections having an identically-formed, seamless, sleeve-like outer metal casing with a uniform cross-section defining a uniform passage along the length thereof, and with a metal mounting leaf laterally extending therefrom, the casing of said stationary hinge section enclosing within said passage a first plastic block assembly having said axial opening and said means for selective adjustment integrally formed therein, and the casing of said riding hinge section enclosing a second plastic block assembly having said axial opening and said cam surface integrally formed therein, said block assemblies arranged within said casings such that said casing and leaf of said riding section are mounted in an axial position 180° opposite said stationary hinge section when said hinge is assembled.

2. A device as defined in claim 1 wherein: said block assembly of said riding hinge section comprises a cap piece and a cam piece disposed along said hinge axis, said cap and cam pieces having parallel, flat, axially facing end surfaces with said cam piece being disposed facing said stationary hinge section and said axial opening of said cam piece having an enlarged counterbore extending inwardly from the said flat face thereof facing said stationary hinge section to receive the said projecting upper end of said sleeve, the inner base end of said counterbore being shaped to provide the said cam surface on said riding hinge section; and said stationary hinge section block assembly comprises a sleeve receiving piece and a cap disposed along said hinge axis having parallel, flat, axially facing end surfaces, said sleeve receiving piece being disposed facing said riding hinge section and having said axial opening thereof provided with an enlarged counterbore extending inwardly from the said flat face thereof facing said riding hinge section for retaining said sleeve therein.

3. A device as defined in claim 2 wherein each block assembly has distal end portions extending endwise beyond each end of its respective casing, said extending portions having a radially outward extending flange around the periphery thereof, said flange on said cap piece of said riding hinge section and said sleeve receiving piece of said stationary hinge engaging said casing to effect vertical support for said block assemblies within said casings.

4. A device as defined in claim 3 wherein said casing has a generally rectangular cross-section, and said mounting leaf is generally flat, wherein on surface of said rectangular casing is fixedly secured flatwise against said mounting leaf.

5. A device as defined in claim 4 wherein said block assembly has an outer transverse cross-section, slightly smaller and co-extensive with the inner surface of said rectangular casing, and the outer surface of said block assembly has raised, generally axially extending ribs located between said distal ends of said block assembly for force fitting said block assembly within said casing.

* * * * *